United States Patent [19]

Yoshiyasu et al.

[11] Patent Number: 4,516,003

[45] Date of Patent: May 7, 1985

[54] CIRCUIT BREAKER WITH ARC LIGHT ABSORBER

[75] Inventors: Hajimu Yoshiyasu; Shirou Murata, both of Itami; Fumiyuki Hisatsune, Fukuyama; Shinji Yamagata, Fukuyama; Junichi Terachi, Fukuyama, all of Japan

[73] Assignee: Mitsubishi Denki Kabushiki Kaisha, Tokyo, Japan

[21] Appl. No.: 485,582

[22] Filed: Apr. 14, 1983

[30] Foreign Application Priority Data

Jun. 15, 1982 [JP] Japan ..... 57-90604
Oct. 22, 1982 [JP] Japan ..... 57-186304
Oct. 29, 1982 [JP] Japan ..... 57-165390

[51] Int. Cl.[3] ..... H01H 33/00
[52] U.S. Cl. ..... 200/144 C; 200/149 A
[58] Field of Search ..... 200/144 C, 149 A, 148 G

[56] References Cited

U.S. PATENT DOCUMENTS 2,864,919 12/1958 Stringfellow ..... 200/144 C
3,236,979 2/1966 Latour ..... 200/144 C
3,995,130 11/1976 Mauthe et al. ..... 200/148 G
4,436,831 3/1984 Nishizako et al. ..... 200/144 C

FOREIGN PATENT DOCUMENTS 54-57453 4/1979 Japan .
55-46487 4/1980 Japan .
56-112842 8/1981 Japan .
56-143635 11/1981 Japan .
56-176447 12/1981 Japan .
57-8118 2/1982 Japan .
57-45139 3/1982 Japan .
57-69605 4/1982 Japan .

*Primary Examiner*—Robert S. Macon
*Attorney, Agent, or Firm*—Wenderoth, Lind & Ponack

[57] ABSTRACT

A circuit breaker with an arc light absorber comprising: a pair of electric contactors contained in an insulating container for opening or closing an electric circuit, and having electric conductors and contacts provided on said conductors, and a pair of side walls on both sides of said contactors at positions for covering all the locuses of said contacts when said contactors are opened or closed, said side walls being formed of a composite material having one or more of fiber, net or porous material having more than 35% apparent porosity.

12 Claims, 18 Drawing Figures

CIRCUIT BREAKER WITH ARC LIGHT ABSORBER

BACKGROUND OF THE INVENTION

This invention relates to a circuit breaker in which pressure in a container of the breaker is suppressed. The circuit breaker in this invention generates an arc in a container, normally a small-sized container such as in a circuit breaker, a current limiter or an electromagnetic switch.

A prior art circuit breaker will be described below.

FIGS. 1A, 1B and 1C are sectional views showing a conventional circuit breaker in different operating states.

Numeral 1 designates a cover, and numeral 2 a base, which forms an insulating container 3 with the cover 2. Numeral 4 designates a stationary contactor, which has a stationary conductor 5 and a stationary contact 6 at one end of the conductor 5, and the other end of the conductor 5 becomes a terminal connected to an external conductor (not shown). Numeral 7 designates a movable contactor, which has a movable conductor 8 and a movable contact 9 disposed oppositely to the contact 6 at one end of the conductor 8. Numeral 10 designates a movable contactor unit, and numeral 11 a movable element arm, which is attached to a crossbar 12 so that each pole simultaneously opens or closes. Numeral 13 designates an arc extinguishing chamber in which arc extinguishing plates 14 are retained by side plates 15. Numeral 16 designates a toggle linkage, which has an upper link 17 and a lower link 18. The link 17 is connected at one end thereof to a cradle 19 through a shaft 20 at the other end thereof to one end of the link 18 through a shaft 21. The other end of the link 18 is connected to the arm 11 of the contactor unit 10. Numeral 22 designates a tiltable operating handle, and numeral 23 an operating spring, which is provided between the shaft 21 of the linkage 16 and the handle 22. Numerals 24 and 25 respectively designate a thermal tripping mechanism and an electromagnetic tripping mechanism, which are respectively provided to rotate a trip bar 28 counterclockwise via a bimetal 26 and a movable core 27. Numeral 29 designates a latch, which is engaged at one end thereof with the bar 28 and at the other end thereof with the cradle 19.

When the handle 22 is tilted down to the closing position in the state that the cradle 19 is engaged with the latch 29, the linkage 16 extends, so that the shaft 21 is engaged with the cradle 19, with the result that the contact 9 is brought into contact with the contact 6. This state is shown in FIG. 1A. When the handle 22 is then tilted down to the open position, the linkage 16 is bent to isolate the contact 9 from the contact 6, and the arm 11 is engaged with a cradle shaft 30. This state is shown in FIG. 1B. When an overcurrent flows in the circuit with the contacts in the closed state shown in FIG. 1A, the mechanism 24 or 25 operates, the engagement of the cradle 19 with the latch 29 is ended, the cradle 19 rotates clockwise around the shaft 30 as a center, and is abutted against a stop shaft 31. Since the connecting point of the cradle 19 and the link 17 is past the operating line of the spring 23, the linkage 16 is bent by the elastic force of the spring 23, each pole automatically cooperatively breaks the circuit via the bar 12. This state is shown in FIG. 1C.

The behavior of an arc which is generated when the circuit breaker breaks the current will be described below.

When the contact 9 is contacted with the contact 6, the electric power is supplied sequentially from a power supply side through the conductor 5, the contacts 6 and 9 and the conductor 8 to a load side. When a large current such as a shortcircuiting current flows in this circuit in this state, the contact 9 is separated from the contact 6 as described before. In this case, an arc 32 is generated between the contacts 6 and 9, and an arc voltage is produced between the contacts 6 and 9. Since this arc voltage rises as the distance from the contact 6 to the contact 9 increases and the arc 32 is urged by the magnetic force toward the plate 14 so as to be extended, the arc voltage is further raised. In this manner, an arc current approaches the current zero point, thereby extinguishing the arc to complete the breakage of the arc. The huge injected arc energy eventually becomes thermal energy, and is thus dissipated completely out of the container, but transiently raises the gas temperature in the limited space in the container and accordingly causes an abrupt increase in the gas pressure. This causes a deterioration in the insulation in the circuit breaker and an increase in the quantity of discharging spark escaping from the breaker, and it is thereby feared that an accident such as a power source shortcircuit or damage to the circuit breaker body will occur.

SUMMARY OF THE INVENTION

The present invention has overcome the disadvantages of the above-described prior art circuit breaker. More particularly, the present invention provides a novel circuit breaker with an arc light absorber based on the discovery by the present inventors of an arc phenomenon, and in which a pair of side walls forming an arc light absorber are provided corresponding to the positions of arc runners.

BRIEF DESCRIPTION OF THE DRAWINGS

FIG. 7B is a side view of FIG. 7A;

FIG. 7C is a fragmentary sectional front view of the circuit breaker of this embodiment;

FIG. 8B is a perspective view for explaining the relationship between the contactors and the side views;

FIG. 8C is a perspective view of arc shields in this embodiment;

FIG. 8D is a perspective view of the arc shields when an arc moving path is provided at the arc shield in FIG. 8C;

FIG. 9B is a perspective view for explaining the relationship between the contactors and the side walls; and FIG. 9C is a side view of FIG. 9B.

In the drawings, the same symbols indicate the same or corresponding parts.

DESCRIPTION OF THE PREFERRED EMBODIMENTS

A mechanism of an arc energy consumption based on the creation of the present invention will be first described below.

Figure 1A:
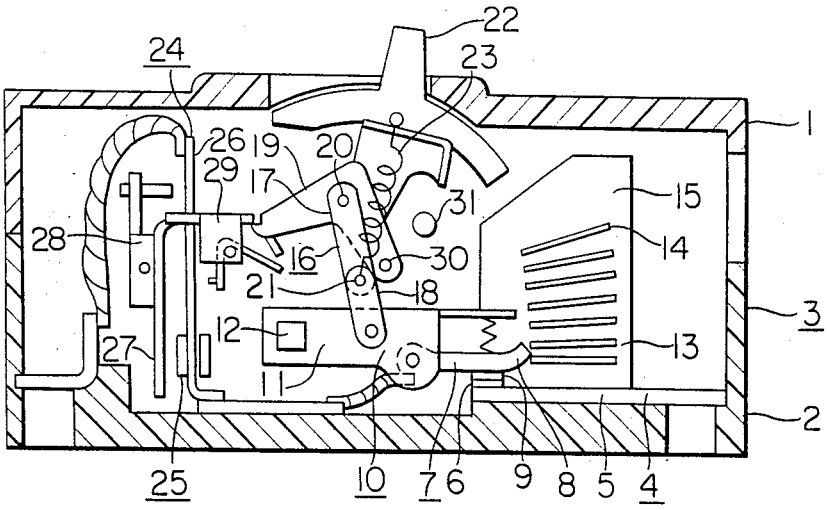
FIG. 1(A) PRIOR ART
FIG. 1A is a fragmentary sectional front view showing the contact closed state of a prior art, circuit breaker.
Figure 1B:
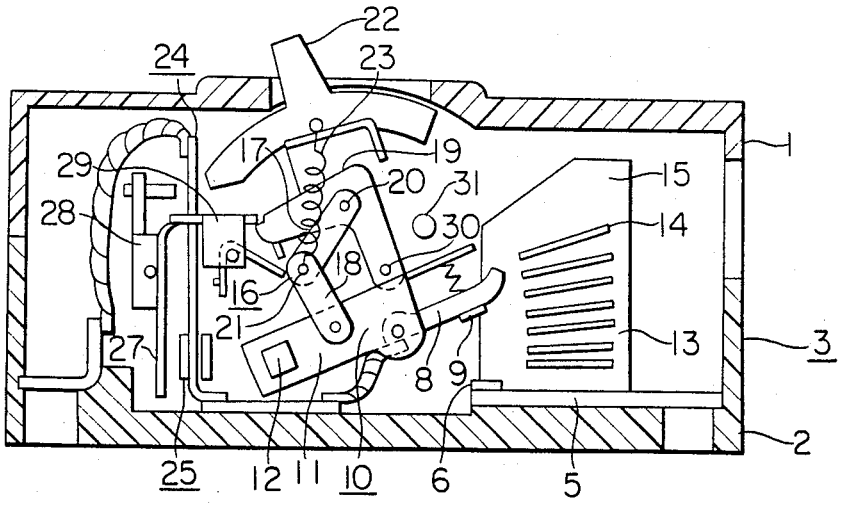
FIG. 1B is a fragmentary sectional front view showing the contact open state by the operation of an operation handle of the circuit breaker in FIG. 1A.
Figure 1C:
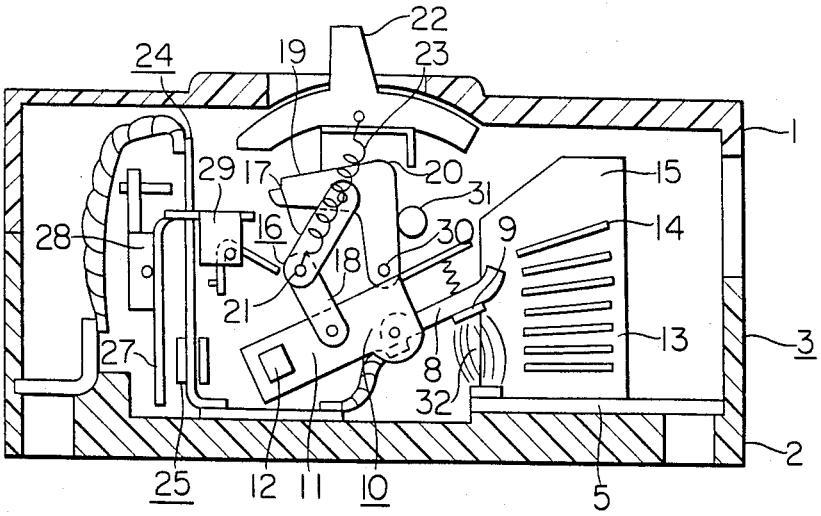
FIG. 1C is a fragmentary sectional front view showing the contact open state at the overcurrent operating time of the circuit breaker in FIG. 1A.
Figure 2:
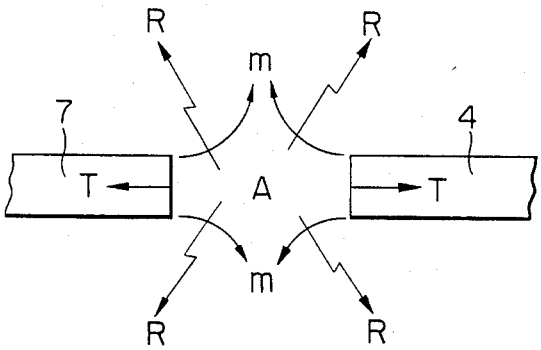
FIG. 2 is a view for explaining the state when the arc produced at the contactor opening time.

FIG. 2 is a view showing an arc A is produced between contactors 4 and 7. In FIG. 2, character T designates a flow of thermal energy which is dissipated from the arc A through the contactors, character m the flows of the energy of metallic particles which are released from the arc space, and character R the flows of energy caused by light which is irradiated from the arc space. In FIG. 2, the energy injected to the arc A is generally consumed by the flows T, m and R of the above three energies. The thermal energy T which is conducted to electrodes is extremely small, and most of the energy is carried away by the flows m and T. In the mechanism of the consumption of the energy of the arc A, it has theretofore been considered that the flows m in FIG. 2 are almost of the energies, and the energy of the flows R has been substantially ignored, but it has been found by the recent studies of the present inventors that the consumption of the energy by the flows R and hence the energy of light is so huge as to reach approximately 70% of the energy injected into the arc A.

In other words, the consumption of the energy injected into the arc A can be formulated as below.

$$P_W = V \cdot I = P_K + Pth + P_R$$

$$P_K = \tfrac{1}{2} m V^2 + m \cdot C_p \cdot T$$

where $P_W$: instantaneous injection energy

V: arc voltage

I: current

V·I: instantaneous electric energy injected into the arc $R_K$: quantity of instantaneous energy which is carried by the metallic particles $mv^2/2$: quantity of instantaneous energy carried away when the metallic particles of mg scatter at a speed v $m \cdot C_p \cdot T$: quantity of instantaneous energy carried away when the gas (the gas of the metallic particles) of constant-pressure specific head $C_P$ pth: quantity of instantaneous energy carried away from the arc space to the contactor via thermal conduction $P_R$: quantity of instantaneous energy irradiated directly from the arc via light The above quantities vary according to the shape of the contactors and the length of the arc. When the length of the arc is 10 to 20 mm, $P_K$=10 to 20%, Pth=5%, and $P_R$=75 to 85%.

Figure 3:
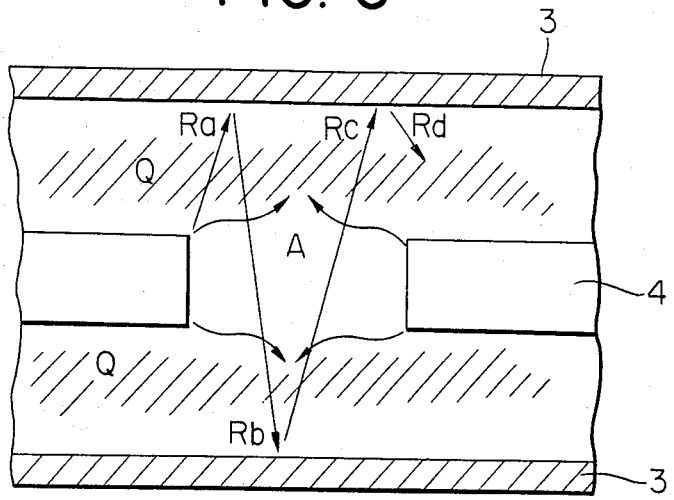
FIG. 3 is a view for explaining the state when the arc produced at the contactor opening time is enclosed in a container.

The state in which the arc A is enclosed in the container is shown in FIG. 3. When the arc A is enclosed in the container 3, the space in the container 3 is filled with the metallic particles and reaches a high temperature. The above state is strong particularly in the gas space Q (the space Q designated by shading lines in FIG. 3) around the periphery of an arc positive column A. The light irradiated from the arc A is irradiated from the arc positive column A to the wall of the container 3, and is reflected from the wall. The reflected light is scattered, is passed again through the high temperature space in which the metallic particles are present, and is again irradiated to the wall surface. Such courses are repeated until the quantity of light becomes zero. One path of the light reflected in this way is shown by Ra, Rb, Rc and Rd in FIG. 3.

The consumption of the light irradiated from the arc A is at the following two points in the above course.

(1) Absorption at the wall surface (2) Absorption in the arc space and peripheral (high temperature) gas space and hence by the gas space The light irradiated from the arc includes wavelengths from far ultraviolet less than 2000 Å to far infrared more than 1 μm and a wavelength range which is continous spectra and linear spectra. The wall surface of the general container has a light absorption capability only in the range of approximately 4000 Å to 5500 Å even if the surface is black, and partly absorbs in the other range, but mostly reflects. However, the absorptions in the arc space and the peripheral high temperature gas space become as described below.

When the light of wavelength λ is irradiated to the gas space having a length L, and uniform composition and temperature, the quantity of light absorption by the gas space can be calculated as below.

$$Ia = Ae \cdot n \cdot L \cdot Iin \quad (1)$$

where

Ia: absorption energy by gas

Ae: absorption probability

Iin: irradiated light energy n: particle density

L: length of light path of the light However, the formula (1) represents the quantity of absorption energy for special wavelength λ. The Ae is the absorption probability for the special wavelength λ, and is a function of the wavelength λ, gas temperature and type of the particles.

In the formula (1), the absorption coefficient becomes the largest in gas of the same type as a light source gas for irradiating the same light (i.e., the type and the temperature of the particles are the same) in both the continuous spectra and the linear spectra according to the teaching of quantum mechanics. In other words, the arc space and the peripheral gas space absorb the most light irradiated from the arc space.

In the formula (1), the quantity Ia of the absorption energy of the light is proportional to the length L of the light path. As shown in FIG. 3, when the light from the arc space is reflected from the wall surface, the L in the formula (1) is increased by the number of times of reflections of the light, and the quantity of the light energy absorbed in the high temperature section of the arc space is increased.

This means that the energy of the light irradiated by the arc A is eventually absorbed by the gas in the container 3, thereby rising the gas temperature and accordingly the gas pressure.

It is the premise of the present invention that, in order to effectively absorb the energy of the light which reaches approximately 70% of the energy injected to the arc, a special material is used and one or more types of fiber, net and highly porous material having more than 35% of porosity for effectively absorbing the light irradiated from the arc are selectively disposed at a special position for receiving the energy of the light of the arc in the container of the circuit breaker, thereby absorbing a great deal of the light in the container so as to lower the temperature of the gas space and to lower the pressure.

The above-described fiber is selected from inorganic materials, metals, composite materials, woven materials and non-woven fabric, and it is necessary that it have thermal strength since it is installed in the space which is exposed to the high temperature arc.

The above-described net includes inorganic materials, metals, composite materials, and further superposed materials in multilayers of fine metal gauze, woven strands to be selected. In the case of the net, it is also necessary to have thermal strength.

Of the above-described materials of the fiber and the net, the inorganic materials includes ceramics, carbon, asbestos, and the optimum metals include Fe, Cu, and may include plated Zn or Ni.

The highly porous material is generally a material from among metals, inorganic materials and organic materials which have a number of fine holes in a solid structure, and are classified with regard to the relationship between the material and the fine holes into material which contains as a main body solid particles sintered and solidified at the contacting points therebetween and the material which contains in a main body holes in such a manner that partition walls forming the holes are solid material. In the present invention, the term blank means the material before being machined to a concrete shape, i.e. simply "a material".

When the materials of the blanks are further more specifically classified, the material can be classified into material in which the gaps among the particles exists as fine holes, material in which the gaps among the particles commonly exist as fine holes in the particles, and material which contains foamed holes therein. The materials are generally classified into material which has air permeability and water permeability, and material which has pores individually independent from each other without air permeability.

The shape of the above fine holes is very complicated, and is generally classified into open holes and closed holes, the structures of which are expressed by the volume of the fine holes or porosity, the diameter of the fine holes and the distribution of the diameters of the fine holes and specific surface area.

The true porosity is expressed by the volume of all the open and closed holes contained in the porous material relative to the total volume (bulk volume) of the material, i.e., percentage, which is measured by a substitution method and an absorption method with liquid or gas, but can be calculated as described below as defined in the method of measuring the specific weight and the porosity of a refractory heat insulating brick of JISR 2614 (Japanese Industrial Standard, the Ceramic Industry No. 2614).

$$\text{True porosity} = (1 - \frac{\text{Bulk specific weight}}{\text{True specific weight}} \times 100\%$$

The apparent porosity is expressed by the volume of the open holes with respect to the total volume (bulk volume) of the blank, i.e., percentage, which can be calculated as described below as defined by the method of measuring the apparent porosity, absorption rate and specific weight of a refractory heat insulating brick of JISR 2205 (Japanese Industrial Standard, the Ceramic Industry No. 2205). The apparent porosity may also be defined as an effective porosity.

$$\text{Apparent porosity} = \frac{\text{Water weight} - \text{dry weight}}{\text{Water weight} - \text{underwater weight}} \times 100\%$$

The diameter of the fine holes is obtained by the measured values of the volume of the fine holes and the specific surface area, and includes several Å (Angstrom) to several mm from the size near the size of an atom or ion to the boundary gap of the particle group, which is generally defined as the mean value of the distribution. The diameter of the fine holes of the porous blank can be obtained by measuring the shape, size and distribution of the pores with a microscope, by a mercury press-fitting method. In order to accurately know the shape of the composite pores and the state of the distribution of the pores, it is generally perferable to employ a microscope as a direct method.

The measurement of the specific surface area is performed frequently by a BET method which obtains the result by utilizing adsorption isothermal lines at the respective temperatures of various adsorptive gases, and nitrogen gas is frequently used.

The patterns of the absorption of the energy of the light and the decrease of the gas pressure by the absorption with the special material according to the present invention will be described for an example of an inorganic porous material.

Figure 4:
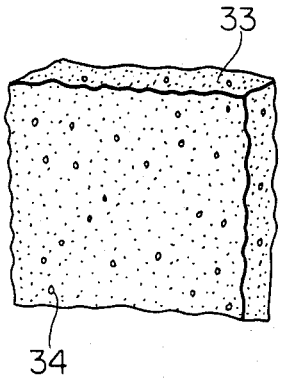
FIG. 4 is a perspective view showing an inorganic porous material necessary to form an arc light absorber.
Figure 5:
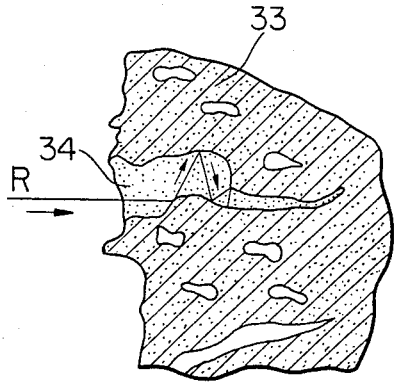
FIG. 5 is a fragmentary sectional view of the part of the material expanded in FIG. 4.

FIG. 4 is a perspective view showing an inorganic porous blank, and FIG. 5 is an enlarged fragmentary sectional view of FIG. 4. In FIGS. 4 and 5, numeral 33 designates an inorganic porous blank, and numeral 34 the open holes communicating with the surface of the blank. The diameters of the hole 34 are distributed in the range from several microns to several mm in various manners.

When the light is incident to the hole 34 when the light is incident to the blank 33 as designated by R in FIG. 5, the light is irradiated onto the wall surface of the blank, is then reflected from the wall surface, is reflected in multiple ways in the hole, and is eventually absorbed 100% by the wall surface. In other words, the light incident to the hole 34 is absorbed directly in the surface of the blank, and becomes heat in the hole.

Figure 6:
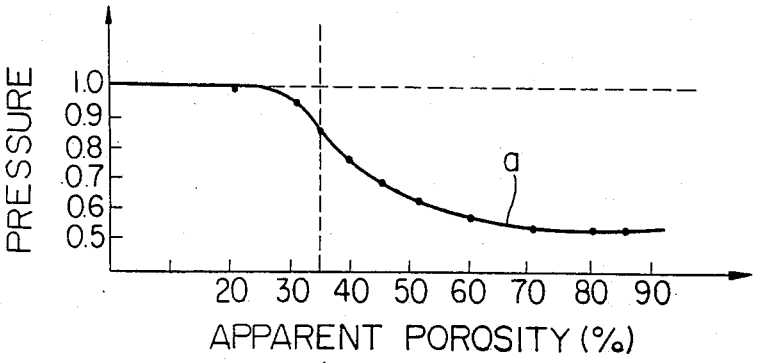
FIG. 6 is a characteristic curve diamgram for showing the relationship between the apparent porosity of the inorganic porous material and the pressure in the container for containing the material.

FIG. 6 shows a characteristic curve diagram of the variation in the pressure in the model container in which the inorganic porous material is placed when the apparent porosity of the material is varied. In FIG. 6, the abscissa is the apparent porosity, and the ordinate expresses the pressure relative to a pressure of 1 as a reference when the porosity is 0 when the inner wall of the container is formed of metal such as Cu, Fe or Al. In the experiment AgW contacts were installed at a predetermined gap of 10 mm in a sealed cubic container with a side edge of 10 cm, an arc from a sinusoidal current of 10 kA at the peak was produced for 8 msec, and the pressure in the container produced by the energy of the arc was measured.

The inorganic porous materials used in the above embodiment were pieces of porous porcelain 50 mm×50 mm×4 mm prepared by forming and sintering a raw material of porcelain of cordierite to which was added an inflammable or foaming agent to form the porous material, which had fine holes with a mean diameter in the range of 10 to 300 microns and respective apparent porosities of 20, 30, 35, 40, 45, 50, 60, 70, 80 and 85%. These pieces were disposed on the wall surface of the container to cover 50% of the surface area of the inner surface of the container.

With respect to the diameter of the fine holes, a mean diameter which slightly exceeds the range of the wavelengths of the light to be absorbed and the rate of the fine holes occupying the surface, i.e., the degree of the specific surface area of the fine holes, become important. In the absorption of the light in the fine holes, the deep holes are more effective, and communicating pores are preferable. Since the light irradiated by the arc A has wavelengths distributed in the range of several hundreds Å to 10,000 Å (1 μm), fine holes of several thousands Å to several 1000 μm mean diameter, which slightly exceeds the above wavelengths, are adequate, and a highly porous material has an apparent porosity which exceeds 35% in the area of the holes occupying the surface is useful for absorbing the light irradiated from the arc A. The effect can be particularly improved when the upper limit of the diameter of the fine holes is in the range less than 1000 μm and the specific surface area of the fine holes is larger. According to the experiments, it is confirmed that preferred absorbing characteristic can be obtained for the light irradiated from the arc by a material having a range of mean diameters of the fine holes from 5 μm to 1 mm. It is also observed that a glass material having 5 or 20 μm holes absorbs the light irradiated from the arc A very well.

As seen from the characteristic curve a in FIG. 6, the pores of the inorganic porous material absorb the light energy, and act to lower the pressure in the circuit breaker, which effect increases as the apparent porosity of the porous blank is increased, and increases remarkably as the porosity becomes larger than 35%, and which increases in the range up to 85%. When the porosity is further increased, it is necessary to further increase the thickness of the porous material.

When the porosity is increased, the relationship between the apparent porosity and the mechanical strength of the porous blank becomes such that the material becomes brittle, the thermal conductivity of the material decreases, and the material becomes readily fusible by the high heat. When the porosity is decreased, the effect of reducing the pressure in the circuit breaker is reduced. Accordingly, the optimum apparent porosity of the porous blank in practical use is in the range of 40 to 70%.

The characteristic trend of FIG. 6 can also be applied to the general inorganic porous materials, and this can be assumed from the above description as to the absorption of the light.

Some prior art circuit breakers use inorganic material, but its object is mainly to protect the organic material container against the arc A, and the necessary characteristics include arc resistance, lifetime, thermal conduction, mechanical strength, insulation and carbonization resistance. An inorganic material which satisfied these characteristics is composed of a material which has a tendency toward low porosity, and the object is different from the object of the present invention, and the apparent porosity of the prior art material is approximately 20%.

The highly porous materials are inorganic, metallic and organic materials, and the inorganic materials are particularly characterized as insulating and the high melting point material. These two characteristics are needed for the material to be installed in the container of the circuit breaker. In other words, since the material is electrically insulating, which does not have an adverse influence on the breakage, and since the material has a high melting point, the material does not become molten nor produce gas, even if the material is exposed to high temperature, and the material is optimum as the pressure suppressing material.

The inorganic porous materials can be porous porcelain, refractory material, glass, and cured cement, all of which can be used to decrease the gas pressure in the circuit breaker. The porous materials of the organic type have problems with respect to the heat resistance and gas production, the porous materials of the metal type have problsm with respect to the insulation and pressure resistance, and are respectively limited in the places where they can be used.

In the circuit breaker in which arc runners are respectively provided on the conductors 5 and 8, an arc produced at the contacts upon opening of the contacts is transferred to the arc runners, and hence the end sides of the arc runners via magnetic force and the arc is elongated. Since this arc has huge energy, the arc raises the temperature of the gas in the container, thereby widely dissociating the ionizing the gas and accelerating the increase in the gas becoming conductive in the container. As a result, the arc is transferred to the arc runners, is elongated, and a becomes higher voltage arc. Since this high voltage arc tends to have a lower stable voltage and the gas becoming conductive at high temperature fills the container, the arc reversely returns to the contacts, thereby decreasing the arc voltage. This greatly reduces the breaking performance of the circuit breaker.

The present invention contemplates to eliminate the above-described problems of the prior art circuit breaker.

Embodiments of the present invention will now be described with reference to the accompanying drawings.

Figure 7A:
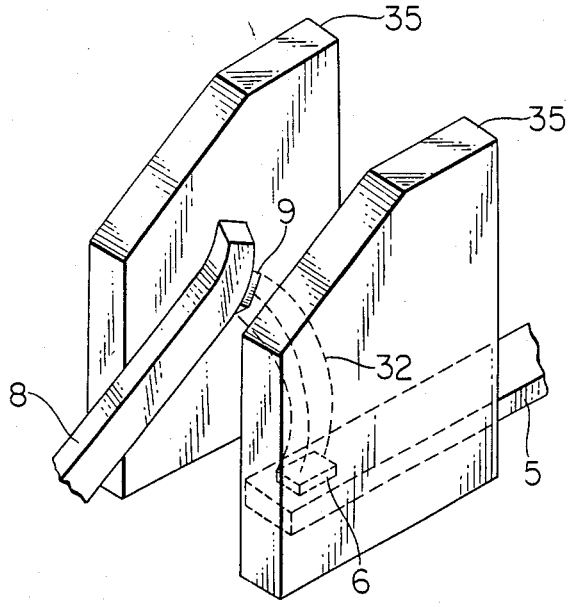
FIGS. 7A, 7B and 7C are views showing an embodiment of the present invention, FIG. 7A being a perspective view for explaining the relationship between the contactors and the side walls.
Figure 7B:
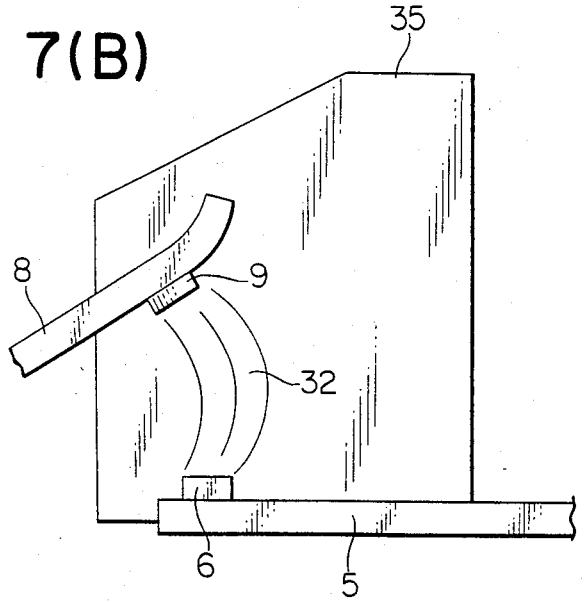
Figure 7C:
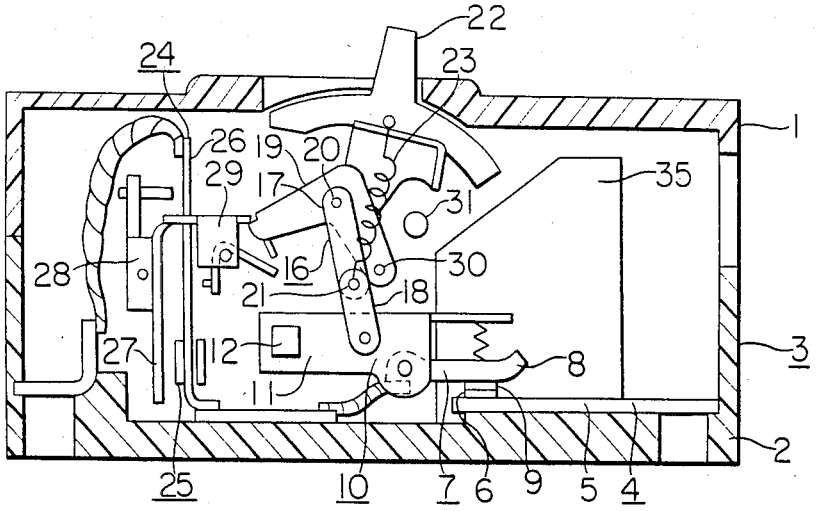

FIG. 7A is a perspective view for explaining the essential portion of the circuit breaker in this embodiment, FIG. 7B is a side view of FIG. 7A, and FIG. 7C is a side sectional view showing the entire circuit breaker. In FIGS. 7A, 7B and 7C, numeral 5 designates a stationary conductor, numeral 6 a stationary contact, numeral 8 a movable conductor, numeral 9 a movable contact, numeral 32 an arc, and numeral 35 side walls which form an arc light absorber, the material of which is an inorganic porous material or a composite material of the inorganic porous material and an organic material having more than 35% apparent porosity, which are positioned and have a size for covering the entire side surfaces of the locus of the contact 9 during opening and closing, and are in spaced opposed relation on opposite sides of the contacts 9 and 6. The other portions are similar to the prior art circuit breaker, and the description thereof will be omitted for brevity.

The operation of this embodiment will be described. The arc that is produced between the contacts 6 and 9 is similar to that of the prior art circuit breaker, but the side walls 35 are disposed at a position near the arc 32, and the entire length of the sides of the arc 32 is covered, so that the stereoscopic angle for receiving the energy of the light irradiated from the arc 32 is, since the walls are disposed in the vicinity of the arc 32, very large, though disposed at the side surfaces of the contacts, and the above-described operation for absorbing the energy of the light can accordingly be very effectively performed. Consequently, the suppression of the internal pressure produced by the arc 32 can be most effective.

As a result, the following effects and advantages are achieved, and an inexpensive circuit breaker can be provided which is safe and has high reliability.

(1) Since the damage to a molded case at the time of breaking of the circuit which tends to occur in the prior art circuit breaker is prevented, the quantity of material in the molding blank forming the cover 1 and the base 2 can be substantially reduced. If the quantity of the material in the blank is not reduced, a more inexpensive blank having low mechanical strength can be selected.

(2) Since the increase in the internal pressure at the time of circuit breaking can be suppressed, the quantity of the arc discharging spark can be reduced, a secondary fire accident due to shortcircuit of a power supply flowing in and out of the molded case which tends to occur at the time of interrupting a particularly large current can be eliminated.

(3) Since the temperature rise of the arc can be suppressed by the suppression of the internal pressure rise, the decreases in the resistance between the metal in the vicinity of the arc 32 and the power supply caused by the melting and evaporating of the insulator and the resistance between the phases can be prevented.

(4) Since the surfaces of the side walls 35 are not vitrified but crystallized due to the direct irradiation of the arc 32 when an inorganic porous material which mainly contains magnesia or zirconia is used as the porous material forming the side walls 35, the resistance of the surface is not lowered during the arc period. Accordingly, good breaking performance can be obtained.

(5) When the surface of the porous material forming the side walls 35 is heat treated and organic material is suitably mixed with the inorganic porous material, the precipitation of fine powder from the side walls 35 due to the vibration and impact of the circuit breaker can be prevented.

Figure 8A:
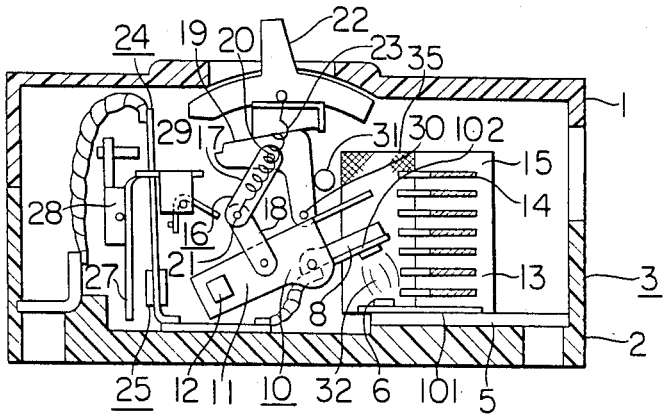
FIGS. 8A, 8B, 8C and 8D are views showing another embodiment of the present invention, FIG. 8A being a fragmentary sectional front view of the circuit breaker of this embodiment.
Figure 8B:
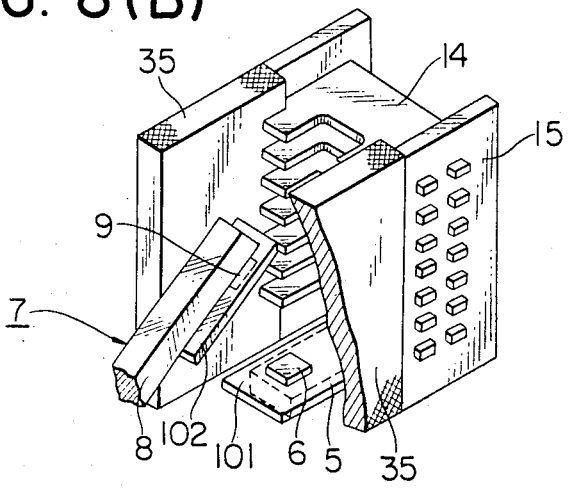
Figure 8C:
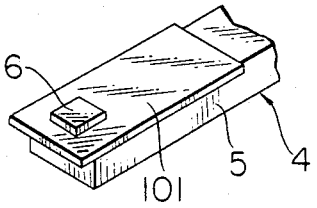
Figure 8D:
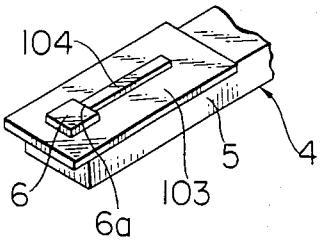

FIG. 8A shows another embodiment of the present invention. In FIG. 8A, numerals 101 and 102 designate arc shields, which are formed of a high resistance material having a resistivity higher than the material forming the conductors 5 and 6. As shown in FIGS. 8B, 8C and 8D, the arc shields 101 and 102 are respectively fixed to the conductors 5 and 8 and surround the outer peripheries of the contacts 6 and 9. The high resistance material forming the shields 101 and 102 comprises high resistance metals such as organic or inorganic nickel, ion, copper nickel, copper manganese, iron-carbon, iron nickel and iron chromium.

The arc shields 101 and 102 are readily formed, for example, by covering the conductors 5 and 8 with the above high resistance material such as ceramics by plasma jet metallizing means, or mounting a plate formed of the above high resistance material onto the conductors 5 and 8. According to the above covering means, the shields can not only be simply formed, but can be inexpensively formed and particularly have a reduced weight on the contactor 7. Accordingly, the intertial moment can be reduced, and the separating speed of the contactor 7 is increased, thereby advantageously enhancing the arc voltage.

Numerals 35 indicate side walls forming an arc light absorber, which are formed of a material selected from organic material, an inorganic material, or from a composite material of one or more of fiber, net and porous material and having more than 35% apparent porosity, such as a porous material having more than 35% apparent porosity, and side walls are provided on both sides of the contacts 6 and 9 as shown, for example, in FIG. 8B at a position for receiving the light of the arc 32 produced between the contacts 6 and 9. The other constituents are the same as the prior art circuit breaker, and a description will be omitted here for brevity.

The operation of this embodiment will be described. The arc 32 is produced between the contacts 6 and 9 in the same manner as in the prior art circuit breaker, but since the arc shields 101 and 102 are provided around the outer peripheries of the contacts 6 and 9, the arc 32 is throttled to a narrow space. Consequently, the sectional area of the arc 32 is greatly reduced as compared with a prior art circuit breaker which does not have the shields 101 and 102, and the arc voltage is accordingly greatly raised, thereby improving the current limiting performance.

As described above, the magnitude of the flowing current is reduced, but when the arc voltage is raised, the instantaneous electric energy injected into the circuit (the product of the current and the arc voltage) is increased, the the pressure in the container is considerably increased, thereby risking damage of the circuit breaker body or an increase in the quantity of discharging spark.

However, since the side walls 35 are provided at the position for receiving the light from the arc 32 in the above structure of this embodiment, the light energy of the arc 32 is absorbed by the light absorbing operations of the side walls 35, the arc gas pressure is thus suppressed, thereby reducing the internal pressure in the circuit breaker, and this function is performed without disturbing the function of the arc shields 101 and 102.

FIG. 8D shows a modified example of an arc shield. An arc moving path 104 which is constituted by a groove extending in a direction for carrying the arc away from the end 6*a* of the stationary contact 6 in the arc moving direction, i.e., toward the arc extinguishing plates 14, is formed in the arc shield 103. In this structure, the foot of the arc 32 moves in the arc moving path 104, and the arc 32 moves toward the plates 14. Thus, the arc 32 is readily contacted with the plates 14, thereby improving the breaking performance in the small current range. The above arc shields may also be applied to the other embodiments of the present invention.

When the side walls 35 are made of an inorganic porous material which mainly contains magnesia or zirconia, the side walls 35 are not vitrified but are made crystalline. Accordingly, the insulating resistance of the surfaces of the side walls 35 is not lowered during the arc generating period, thereby obtaining a good breaking performance. When the surfaces of the side walls 35 are heat treated and a suitable organic material is mixed with the inorganic porous material, the precipitation of powder from the side walls 35 due to the vibration and impact of the circuit breaker can be effectively prevented without disturbing the operation of lowering the internal pressure in the circuit breaker.

Figure 9A:
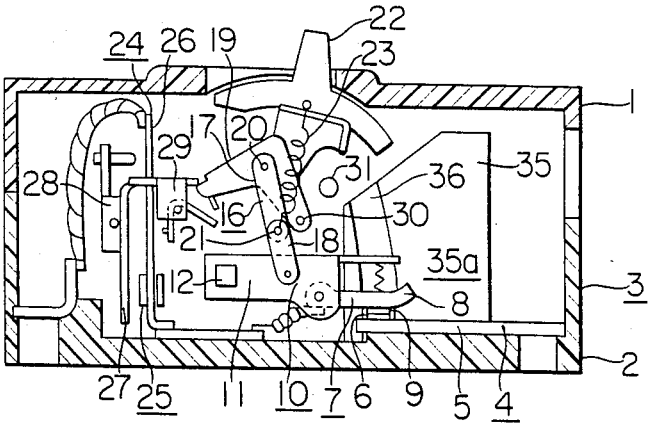
FIGS. 9A, 9B and 9C are views showing still another embodiment of the present invention, FIG. 9A being a fragmentary sectional front view of the circuit breaker of this embodiment.
Figure 9B:
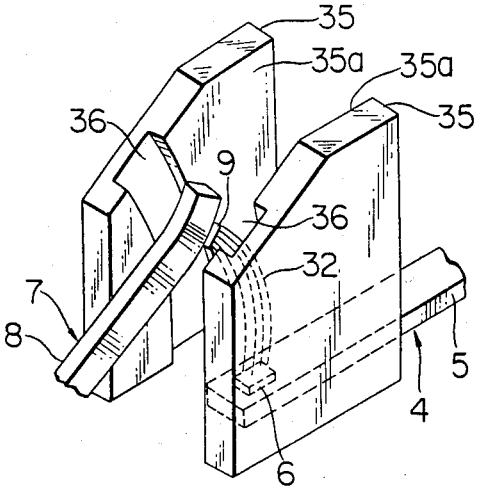
Figure 9C:
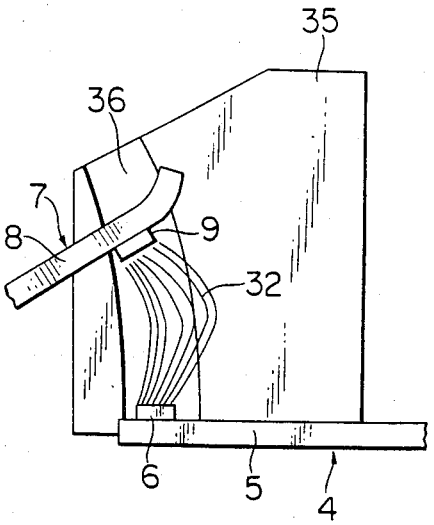

FIGS. 9A-9C show still another embodiment in which recesses are formed in the side walls forming an arc light absorber. In FIG. 9A, a pair of side walls 35 which have an area sufficient to cover all the locuses of the contacts 6 and 9 when a pair of electric contacts 4 and 7 are opened and closed as shown in FIG. 9B are disposed on both sides of the contactors 4 and 7. These side walls 35 are formed of an arc light absorber which is made of a composite material made one or more of fiber, net and a porous material having more than 35% apparent porosity, and recesses 36 corresponding to the locuses of the contacts are respectively formed in the opposed surfaces 35*a* of the side walls 35, respectively.

The operation of this embodiment will be described. The arc 32 is produced as shown in FIG. 9C when the contacts 6 and 9 are opened, but since the side walls 35 which are formed of the arc light absorber formed of the above-described special material are provided, the light energy from the arc 32 is absorbed by the side walls 35. Particularly in this case, the side walls 35 formed of the arc light absorber are disposed at the nearest position to the position of the arc, and the stereoscopic angle for receiving the energy of the light irradiated from the arc 32 becomes very large at the position approaching the arc, even if on both sides of the contacts 6 and 9, and the above-described effects and advantages and hence the operation of absorbing the energy of the light can accordingly be very efficiently performed. Consequently, the increase in internal pressure of the container 3 produced when the arc 32 is produced can be effectively suppressed, with the result that the container 3 is not in danger of being damaged at the time of breaking of the circuit. This makes less important the mechanical strength of the container 3, reduces the quantity of molding material needed for forming the cover 1 and the base 2 forming the container 3, and makes possible an inexpensive blank having low mechanical strength, thereby increasing the degree of freedom of design.

Further, since the internal pressure in the container 3 is decreased, the quantity of arc discharge spark at the time of breaking of the circuit can be reduced, and particularly a secondary fire accident due to a shortcircuit in the power supply flowing in and out the container 3 which tends to occur at the time of breaking of a large current can be prevented. Because the internal pressure is decreased, the temperature of the arc 32 is decreased, and since the arc 32 is between the side walls 35 formed of the arc light absorber, the decreases in the insulating resistance between the power supply and the load caused by the melting and evaporating of the metal and the insulator in the vicinity of the arc 32 and between the phases can be prevented, thereby improving the safety.

Further, since the recesses 36 are provided on the opposed surfaces 35*a* of the side walls 35, respectively corresponding to the locuses of the contacts, the local burnout of the side walls 35 due to the positive column of the arc 32 at the highest temperature can be prevented, thereby sufficiently protecting against the frequent opening and closing operations and frequent circuit breaking operations of the circuit breaker and maintaining the function of the side walls 35 for a long period of time.

What is claimed is:

1. A circuit breaker with an arc light absorber comprising:

a pair of electric contactors contained in an insulating container for opening or closing an electric circuit;

electric conductors extending to said electric contactors and contacts on said conductors; and a pair of side walls provided on both sides of said contactors in spaced opposed relation to each other and having a size for absorbing light from the arc formed when said contactors open and close;

said side walls being formed of a heat resistant, electrically insulating, light absorbing material having more than 35% apparent porosity.

2. A circuit breaker with an arc light absorber according to claim 1, wherein the surfaces of said walls facing said contactors have recesses therein corresponding to the locuses of said contacts.

3. A Circuit breaker with an arc light absorber according to claim 1, further comprising arc shields surrounding said contacts and fixed to said conductors and formed of a high resistance material having a resistivity higher than said conductors.

4. A circuit breaker with an arc light absorber according to claim 1, further comprising arc shields surrounding said contacts and fixed to said conductors and formed of a high resistance material having a resistivity higher than said conductors, and arc moving paths for moving the arc in said arc shields.

5. A circuit breaker with an arc light absorber according to claim 1, wherein the surface of said side wall is hardened by a heat treatment.

6. A circuit breaker with an arc light absorber according to claim 1, wherein the porous material forming said side walls is a material taken from the group consisting of magnesia and zirconia.

7. A circuit breaker with an arc light absorber according to claim 1, wherein said side walls are formed of an inorganic porous material, which has 40% to 70% apparent porosity.

8. A circuit breaker with an arc light absorber according to claim 7, wherein said inorganic porous material is selected from the group consisting of porous porcelain, porous refractory material, porous glass and porous cured cement.

9. A circuit breaker with an arc light absorber according to claim 7, wherein said inorganic porous material has fine holes with mean diameters of from several thousands Å to several 1000 μm.

10. A circuit breaker as claimed in claim 1, wherein said side walls have a size for covering all the locuses of said contacts when said contactors open and close.

11. A circuit breaker as claimed in claim 1, wherein said material is a fiberous material.

12. A circuit breaker as claimed in claim 1, wherein said material is a net material.

* * * * *